US007690425B2

(12) United States Patent
Giacomino

(10) Patent No.: US 7,690,425 B2
(45) Date of Patent: Apr. 6, 2010

(54) DATA LOGGER PLUNGER AND METHOD FOR ITS USE

(75) Inventor: Jeffrey L. Giacomino, Fort Lupton, CO (US)

(73) Assignee: Production Control Services, Inc., Frederick, CO (US)

( * ) Notice: Subject to any disclaimer, the term of this patent is extended or adjusted under 35 U.S.C. 154(b) by 862 days.

(21) Appl. No.: 11/060,513

(22) Filed: Feb. 17, 2005

(65) Prior Publication Data

US 2005/0178543 A1 Aug. 18, 2005

Related U.S. Application Data

(60) Provisional application No. 60/545,679, filed on Feb. 18, 2004.

(51) Int. Cl.
*E21B 47/00* (2006.01)

(52) U.S. Cl. ..... 166/250.11; 166/250.15; 166/66; 166/68; 166/105

(58) Field of Classification Search ..... 166/250.11, 166/205.15, 66, 68, 105, 107
See application file for complete search history.

(56) References Cited

U.S. PATENT DOCUMENTS

| | | | | | |
|---|---|---|---|---|---|
| 2,714,855 | A | | 8/1955 | Brown | 103/52 |
| 3,181,470 | A | | 5/1965 | Clingman | 103/52 |
| 3,412,798 | A | * | 11/1968 | Gregston | 417/56 |
| 4,291,761 | A | | 9/1981 | Watson | |
| 4,502,843 | A | | 3/1985 | Martin | 417/56 |
| 4,664,602 | A | | 5/1987 | Gordon | |
| 5,253,713 | A | | 10/1993 | Gregg et al. | 166/372 |
| 5,333,684 | A | | 8/1994 | Walter et al. | 166/54 |
| 5,984,013 | A | | 11/1999 | Giacomino et al. | 166/373 |
| 6,032,919 | A | | 3/2000 | Giacomino et al. | 251/30.02 |
| 6,045,335 | A | * | 4/2000 | Dinning | 417/59 |
| 6,148,923 | A | | 11/2000 | Casey | 166/372 |
| 6,170,573 | B1 | | 1/2001 | Brunet et al. | |
| 6,176,309 | B1 | | 1/2001 | Bender | 166/68 |
| 6,196,324 | B1 | | 3/2001 | Giacomino et al. | 166/372 |
| 6,241,014 | B1 | | 6/2001 | Majek et al. | 166/53 |
| 6,241,028 | B1 | | 6/2001 | Bijleveld et al. | 175/40 |
| 6,273,690 | B1 | | 8/2001 | Fischer, Jr. et al. | 417/555.2 |
| 6,464,011 | B2 | | 10/2002 | Tubel | |
| 6,554,580 | B1 | | 4/2003 | Mayfield et al. | 417/56 |
| 6,591,737 | B2 | | 7/2003 | Giacomino | |
| 6,634,426 | B2 | | 10/2003 | McCoy et al. | |
| 6,637,510 | B2 | | 10/2003 | Lee | 166/108 |
| 6,669,449 | B2 | | 12/2003 | Giacomino | |
| 6,705,404 | B2 | | 3/2004 | Bosley | 166/372 |

(Continued)

FOREIGN PATENT DOCUMENTS

CA 2 428 618 A1 11/2004

(Continued)

*Primary Examiner*—Jennifer H Gay
*Assistant Examiner*—Robert E Fuller
(74) *Attorney, Agent, or Firm*—Aileen Law; A Law Firm, P.C.

(57) ABSTRACT

A downhole plunger for oil and gas wells comprises an electronic ambient environmental sensor via a cargo bay. Although the sensor is preferably a downhole time, temperature, pressure and flow sensor, the device contemplates the use of any appropriate cargo to ascertain well conditions. The device can also be used to sample fluid. The sensor has a measured data memory.

17 Claims, 15 Drawing Sheets

U.S. PATENT DOCUMENTS

| | | | | |
|---|---|---|---|---|
| 6,725,916 | B2 | 4/2004 | Gray et al. | 166/68.5 |
| 6,746,213 | B2 | 6/2004 | Giacomino | |
| 6,907,926 | B2 | 6/2005 | Bosley | 166/108 |
| 6,945,762 | B2 | 9/2005 | Williams | 417/546 |
| 2003/0141051 | A1 | 7/2003 | Abbott et al. | 166/53 |
| 2003/0155129 | A1 | 8/2003 | Gray et al. | 166/370 |
| 2003/0215337 | A1 | 11/2003 | Lee | 417/56 |
| 2004/0129428 | A1 | 7/2004 | Kelley | 166/372 |
| 2007/0023191 | A1* | 2/2007 | Dreggevik | 166/377 |

FOREIGN PATENT DOCUMENTS

| | | |
|---|---|---|
| RU | 2225502 | 3/2004 |

* cited by examiner

DATA LOGGER PLUNGER AND METHOD FOR ITS USE

CROSS REFERENCE APPLICATIONS

This application is a non-provisional application claiming the benefits of provisional application No. 60/545,679 filed Feb. 18, 2004.

FIELD OF THE INVENTION

The present invention relates to a plunger type oil and gas well lift apparatus for the lifting of formation liquids in a hydrocarbon well. More specifically a plunger is fitted with a time, temperature, pressure and flow electronic sensing and logging device to enable the efficient gathering of downhole ambient conditions.

BACKGROUND OF THE INVENTION

A plunger lift is an apparatus that is used to increase the productivity of oil and gas wells. In the early stages of a well's life, liquid loading is usually not a problem. When rates are high, the well liquids are carried out of the tubing by the high velocity gas. As the well declines, a critical velocity is reached below which the heavier liquids do not make it to the surface and start to fall back to the bottom exerting back pressure on the formation, thus loading up the well. A plunger system is a method of unloading gas in high ratio oil wells without interrupting production. In operation, the plunger travels to the bottom of the well where the loading fluid is picked up by the plunger and is brought to the surface removing all liquids in the tubing. The plunger also keeps the tubing free of paraffin, salt or scale build-up. A plunger lift system works by cycling a well open and closed. During the open time a plunger interfaces between a liquid slug and gas. The gas below the plunger will push the plunger and liquid to the surface. This removal of the liquid from the tubing bore allows an additional volume of gas to flow from a producing well. A plunger lift requires sufficient gas presence within the well to be functional in driving the system. Oil wells making no gas are thus not plunger lift candidates.

As the flow rate and pressures decline in a well, lifting efficiency declines geometrically. Before long the well begins to "load up". This is a condition whereby the gas being produced by the formation can no longer carry the liquid being produced to the surface. There are two reasons this occurs. First, as liquid comes in contact with the wall of the production string of tubing, friction occurs. The velocity of the liquid is slowed, and some of the liquid adheres to the tubing wall, creating a film of liquid on the tubing wall. This liquid does not reach the surface. Secondly, as the flow velocity continues to slow the gas phase can no longer support liquid in either slug form or droplet form. This liquid along with the liquid film on the sides of the tubing begin to fall back to the bottom of the well. In a very aggravated situation, there will be liquid in the bottom of the well with only a small amount of gas being produced at the surface. The produced gas must bubble through the liquid at the bottom of the well and then flow to the surface. Because of the low velocity very little liquid, if any, is carried to the surface by the gas. Thus, as explained previously, a plunger lift will act to remove the accumulated liquid.

A typical installation plunger lift system 100 can be seen in FIG. 1 (prior art). Lubricator assembly 10 is one of the most important components of plunger system 100. Lubricator assembly 10 includes cap 1, integral top bumper spring 2, striking pad 3, and extracting rod 4. Extracting rod 4 may or may not be employed depending on the plunger type. Below lubricator 10 is plunger auto catching device 5 and plunger sensing device 6. Sensing device 6 sends a signal to surface controller 15 upon plunger 200 arrival at the well top. Plunger 200 is shown to represent the plunger of the present invention and will be described below in more detail. Sensing the plunger is used as a programming input to achieve the desired well production, flow times and wellhead operating pressures. Master valve 7 should be sized correctly for tubing 9 and plunger 200. An incorrectly sized master valve will not allow plunger 200 to pass. Master valve 7 should incorporate a full bore opening equal to the tubing 9 size. An oversized valve will allow gas to bypass the plunger causing it to stall in the valve. If the plunger is to be used in a well with relatively high formation pressures, care must be taken to balance tubing 9 size with the casing 8 size. The bottom of a well is typically equipped with a seating nipple/tubing stop 12. Spring standing valve/bottom hole bumper assembly 11 is located near the tubing bottom. The bumper spring is located above the standing valve and can be manufactured as an integral part of the standing valve or as a separate component of the plunger system.

Surface control equipment usually consists of motor valve(s) 14, sensors 6, pressure recorders 16, etc., and electronic controller 15 which opens and closes the well at the surface. Well flow 'F' proceeds downstream when surface controller 15 opens well head flow valves. Controllers operate on time, or pressure, to open or close the surface valves based on operator-determined requirements for production. Modern electronic controllers incorporate features that are user friendly, easy to program, addressing the shortcomings of mechanical controllers and early electronic controllers. Additional features include battery life extension through solar panel recharging, computer memory program retention in the event of battery failure, and built-in lightning protection. For complex operating conditions, controllers can be purchased that have multiple valve capability to fully automate the production process.

In these and other wells it is desirable to measure the downhole temperature and pressure versus time, chemical profiles and other data. This information is used to figure oil and gas reserves and production plans. Conventional methods include dropping special sensors called pressure bombs via cable down the tubing. Pressure bombs can be attached to the wireline or left downhole to be retrieved by fishing at a later date. Special trucks with a crew are used which is expensive for the well operator.

In FIG. 2 (prior art), a special truck called a wireline (also called slickline) rig 200 is used to drop a downhole equipment data logger (temperature and/or pressure and/or time) 207 down tubing 266 of the well. Nominally the tubing is two inches in diameter, and data logger 207 is about three feet long. Wireline rig 200 has an on-board computer 201 for data recording. Hoistable crane 202 supports electric line 206 which usually requires a lubricator 203 and a blowout protector 204. A spool and hoist assembly 205 controls electric line 206. All this special equipment is costly to lease for the well operator. Furthermore, the use of this equipment requires the complete shutdown of the well during the operation of dropping special data logger 207.

What is needed is an improved data logger sensor that can be dropped down a well and retrieved without a wireline rig. The plunger will house and deliver the data logger to the bottom of the well to take readings. Then the well operator can turn the well on to flow the plunger and data logger to the surface without the use of a wireline rig and crew. This sensor should be easily detachable to the plunger and readily plugged into a computer to retrieve the measured downhole temperature and/or pressure. The present invention fulfills these needs for the well operator/producer.

SUMMARY OF THE INVENTION

An aspect of the present invention is to provide a waterproof temperature and/or pressure and/or time sensor and data logger in a conventional downhole plunger.

Another aspect of the present invention is to provide a screw-off attachment to a traditional plunger, wherein the attachment houses the temperature and/or pressure sensor and data logger.

Another aspect of the present invention is to provide a shock absorber in the plunger for the data logger/sensor assembly.

Another aspect of the present invention is to provide various retrieving plungers to fish out a plunger having a data logger mounted inside.

Another aspect of the present invention is to provide a fluid sampler inside a plunger.

Another aspect of the present invention is to provide a metal sample (also known as a corrosion coupon) inside a plunger to retrieve the coupon for chemical analysis.

Another aspect of the present invention is to provide a transport plunger for any payload, wherein the transport plunger is designed to remain downhole until retrieved by a special retriever plunger.

Other aspects of this invention will appear from the following description and appended claims, reference being made to the accompanying drawings forming a part of this specification wherein like reference characters designate corresponding parts in the several views.

Prior art waterproof data loggers are housed in a plunger attachment in the preferred embodiment. The ACR Systems, Inc. NAUTILUS® product line has worked well in prototype testing.

A metal housing about five inches long carries a battery-powered temperature and/or pressure and/or time and/or any sensor and data logger. The plunger is adapted to have a screw-on metal jacket that houses the sensor/logger. After the plunger is adapted with sensor/logger, it is dropped downhole like any other plunger. Normal cyclic operation of the well returns the plunger to the surface without the use of a wireline rig and crew.

When the plunger is retrieved the sensor/logger is removed, and a cable is plugged into the sensor/logger. A computer receives the data for processing and display to the well operator. Standard prior art software is available for the processing and display of the data.

Other embodiments disclose a generic transport plunger which could carry a data logger, a metal sample and/or a fluid sampler, or any payload. Some plunger embodiments are designed to remain downhole until retrieved by a special retriever plunger.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DETAILED DESCRIPTION OF THE DRAWINGS

Figure 3:
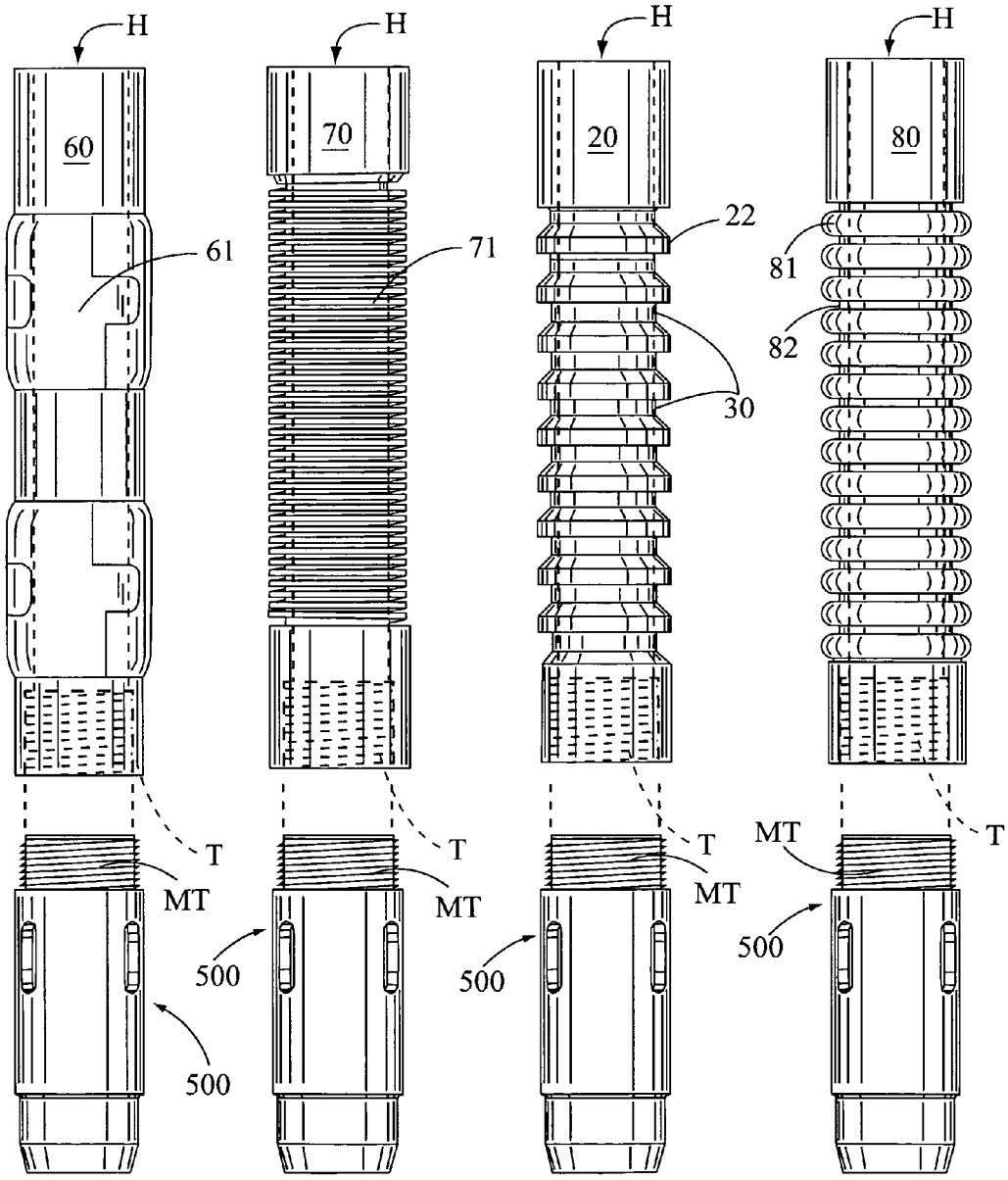
FIG. 3 is a side plan view of conventional plungers adapted to receive a canister containing an electronic data logger.

Referring next to FIG. 3, it shows a side view of various sidewall geometries of plungers that are fitted with a data logger. All geometries described below have an internal orifice indicated by arrow H. All sidewall geometries described below can be found in present industrial offerings. These sidewall geometries are described as follows:

A. Plunger mandrel 20 is shown with solid ring 22 sidewall geometry. Solid sidewall rings 22 can be made of various materials such as steel, polymer materials, including but not limited to TEFLON®, stainless steel, etc.

B. Plunger mandrel 80 is shown with shifting ring 81 sidewall geometry. Shifting rings 81 allows for continuous contact against the tubing to produce an effective seal with wiping action to ensure that all scale, salt or paraffin is removed from the tubing wall. Shifting rings 81 are individually separated at each upper surface and lower surface by air gap 82.

C. Plunger 60 has spring-loaded interlocking pads 61 in one or more sections. Interlocking pads 61 expand and contract to compensate for any irregularities in the tubing thus creating a tight friction seal.

D. Plunger 70 incorporates a spiral-wound, flexible nylon brush 71 surface to create a seal and allow the plunger to travel despite the presence of sand, coal fines, tubing irregularities, etc.

Figure 5:
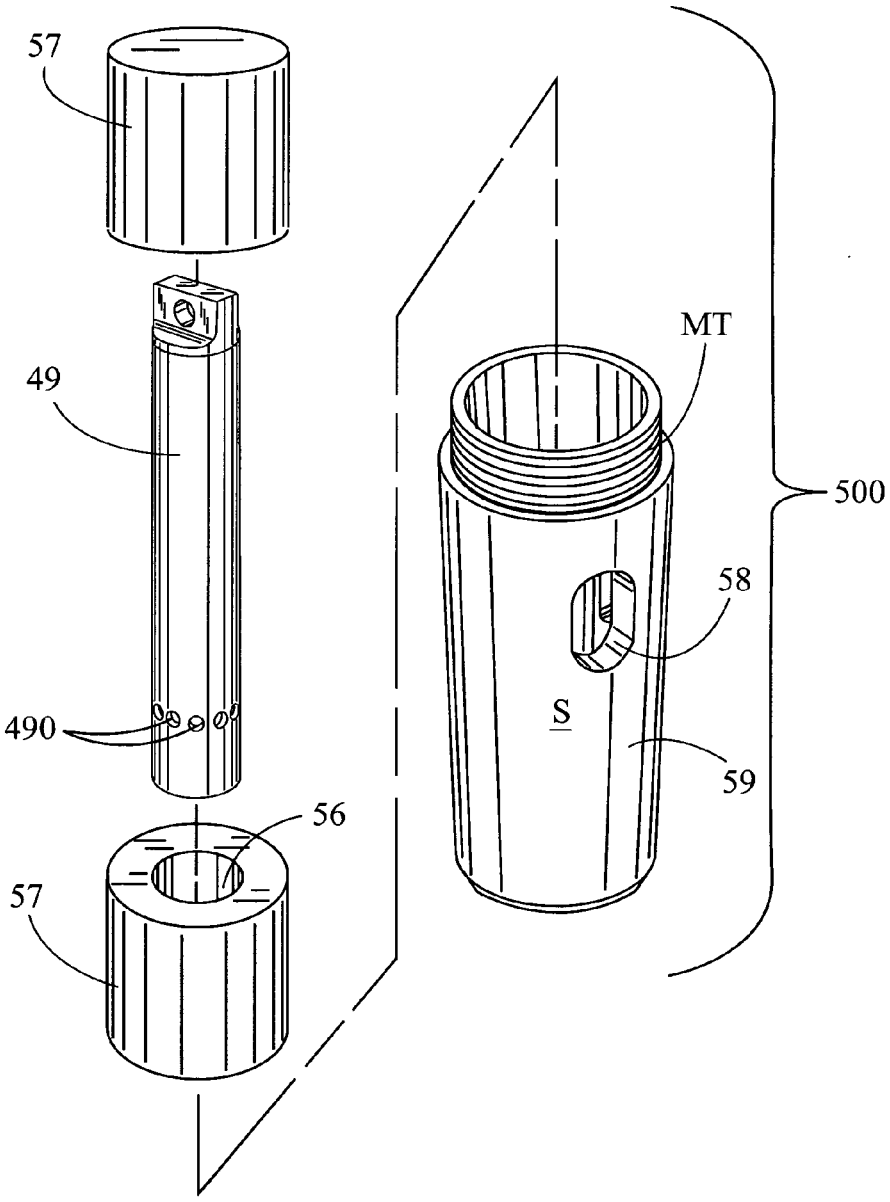
FIG. 5 is an exploded view of the preferred embodiment data logger canister.

The internal female threads T can receive the external male threads MT of data logger canister 59 shown in FIG. 5.

Figure 4:
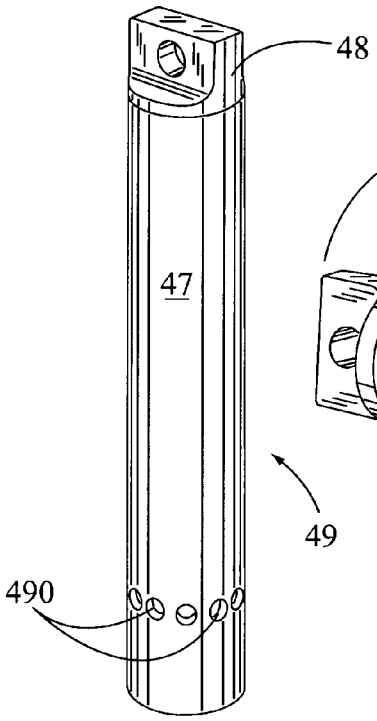
Fig. 4 (PRIOR ART)
FIG. 4 (prior art) is a perspective view of a prior art electronic data logger used herein.
Figure 4A:
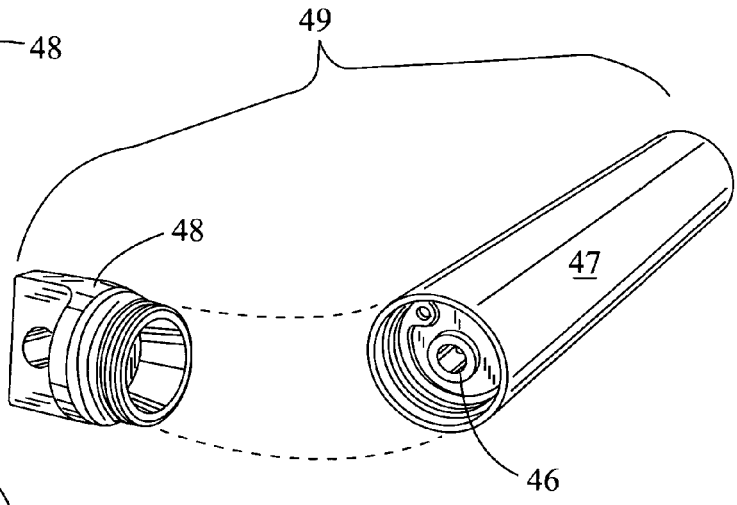
Fig. 4A (PRIOR ART)
FIG. 4A (prior art) is an exploded view of the FIG. 4 data logger.

Referring next to FIG. 4, a commercially available waterproof data logger 49 is shown. The plug 48 is shown screwed into the body 47. FIG. 4A shows the input jack 46 for the interface jack 81 shown in FIG. 8. Some data loggers can have pressure sensing holes 490. The present invention in one sense describes a microprocessor mounted in a plunger. The disclosed embodiment uses a commercial data logger 49. However, this application supports the new, useful and non-obvious combination of a generic microprocessor mounted in a plunger. Uses could include real time communications using the metal tubing, computations downhole, video camera and downhole process control. This invention in its broadest sense encompasses a cargo bay for a payload in a plunger. The payload can be a microprocessor, a metal sample (also known as a corrosion coupon), a fluid sampler, a transmitter, and various sensors.

Nominal specifications for one of many available data loggers follows below:

| GENERAL |
|---|
| Size: |
| 18 mm × 127 mm (0.71" × 5.00") |
| Weight (aluminum case): |
| 51 grams(1.8 ounces) - aluminum case. |
| 112 grams (4 ounces) - stainless steel case. |
| Case Material: |
| Anodized aluminum or stainless steel. |
| Operating Limits: |
| NAUTILUS85 ®: −40° C. to 85° C. (−40° F. to 185° F.) and waterproof. |
| NAUTILUS135 ®: 10° C. to 135° C. (50° F. to 275° F.) and waterproof. |
| Operating Pressure Range: |
| Up to 2000 PSI. |
| Clock Accuracy: |
| +/−2 seconds per day. |
| Battery: |
| 3.6 volt Lithium, 0.95 Amp-Hour. |
| Power Consumption: |
| 5 to 10 micro amps (continuous). |
| Battery Life |
| NAUTILUS85 ®: 10-year warranty (under normal use). |
| Factory replaceable. |
| NAUTILUS135 ®: 3-year warranty (under normal use). |
| Factory replaceable. |
| Memory Size: |
| 32K (244,800 data points). |
| Sampling Methods: |
| 1. Continuous (First-in, First-out) |
| 2. Stop when full (Fill-then-stop). |
| 3. Delayed start. |
| Sampling Rates: |
| 8 seconds to 34 minute intervals. Readings stored to memory can be spot or averaged over the sample |

-continued

| GENERAL |
|---|
| over the sample interval (except for the 8 second interval). |
| Resolution: |
| 8 bit (1 part in 256). |
| PC Requirements: |
| IBM PC or 100% compatible running MS ® Windows 3.1, '95, '98, 2000, ME or NT, with at least 2 MB RAM, 2 MB of hard drive disk space and one free serial port. |
| Mounting: |
| Locking hole on cap. |

Combination pressure and/or temperature sensors are available.

Referring next to FIG. 5, data logger canister 59 is preferably made of metal to withstand the downhole environment. Canister 59 is not limited to holding a data logger. It can hold anything the well operator chooses, including a fluid sampler, metal sample (also known as a corrosion coupon), a microprocessor, a trace material that flows out of a container downhole, etc. Canister 59 shall also be called a cargo bay for a payload. Slot(s) 58 in sidewall S allows downhole fluids to contact data logger 49, wherein data logger 49 measures and logs chosen variables including but not limited to time, temperature, pressure, and flow. Data logger 49 is protected in stops 57, each having a receiving hole 56 for the appropriate end of data logger 49. Stops 57 could be made of rubber. To remove a data logger canister 59 is unscrewed from the plunger, and the data logger is removed from stops 57. Assembly 500 connotes canister 59 and its contents.

Figure 6:
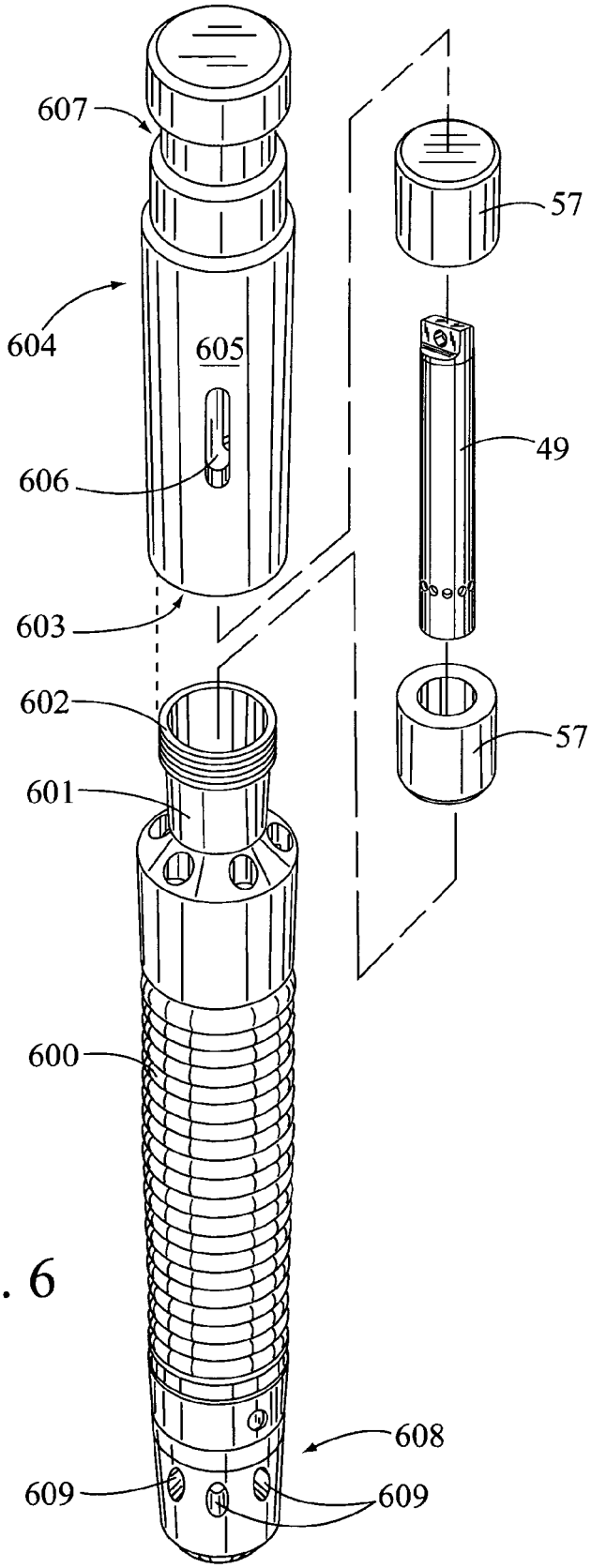
FIG. 6 is an exploded view of a top mounted data logger canister.

Referring next to FIG. 6, plunger 600 has upper extension 601 with male threads 602. Exit holes 608 connect to an internal channel and to entry holes 609. Data logger canister 604 has a bottom with matching female threads 603 to connect to threads 602. Sidewall 605 has slot(s) 606 to enable downhole fluids to contact data logger 49. Outside diameter fishing neck 607 is standard in the industry to retrieve plunger 600. Prior art by-pass end 608 can be manually adjusted to open/close holes 609 to regulate the fall and arrival time of the plunger and data logger.

Figure 7:
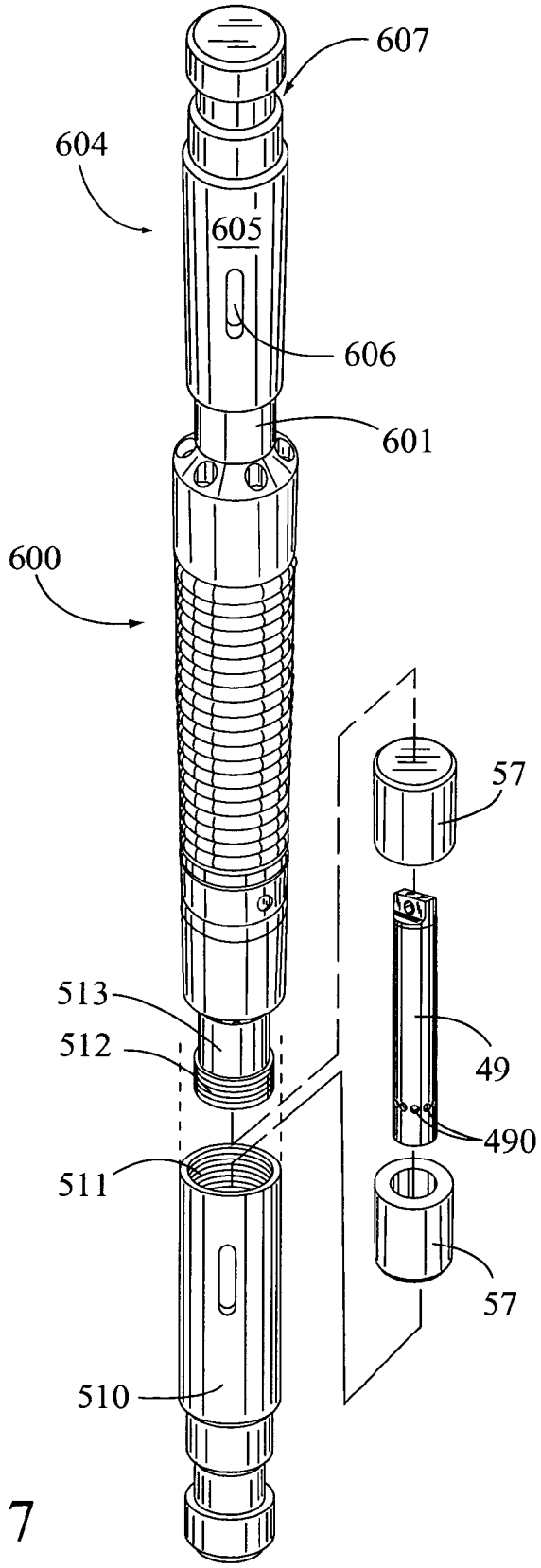
FIG. 7 is a partially exploded view of a dual data logger plunger.

Referring next to FIG. 7, plunger 600 has an upper extension 601, wherein male threads 602 (not shown) mate with female threads 603 (not shown) at the bottom of data logger canister 604. Sidewall 605 has slot(s) 606. A second data logger canister assembly 510 contains a second data logger 49. Canister 510 is equivalent to canister 59 of FIG. 5 except it has female threads 511 that mate with male threads 512 of extension 513.

Figure 8:
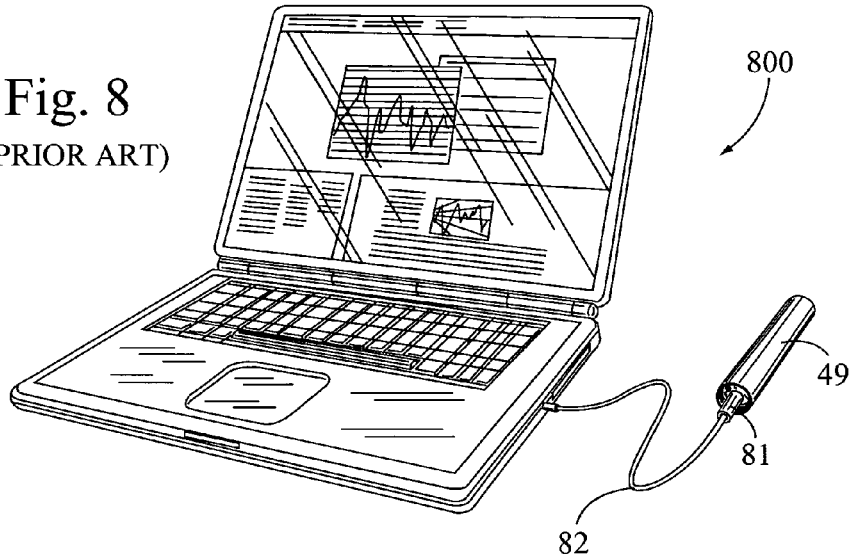
Fig. 8 (PRIOR ART)
FIG. 8 (prior art) is a perspective view of a computer connected to the data logger.

Referring next to FIG. 8, data logger 49 is connected to computer 800 via interface jack 81 and cable 82. Available software for computer 800 may include a communications package as summarized below.

Available software incorporates the advantages of simple functionality with advanced features that are normally associated with more advanced data acquisition software. It is designed specifically for single channel waterproof temperature data loggers.

To set up, download or view real time information from a typical data logger all that is required is an interface cable and appropriate software. Plug the connector of the interface cable into the computer serial port and stereo cable 82 into logger 49.

Since the software typically comes complete with built-in menus for Sample Rate, Start Delay, Settable ID and more, set up is fast and easy. Real time readings are displayed allowing the user to ensure that the logger's set up is correct before placing it in the field.

To back up stored data or view the temperature in real time, plug it directly into the serial port of the computer. The software automatically displays the logged temperature readings in a graphical format as well as the current real time reading. To use EXCEL®, LOTUS®, or other popular spreadsheet programs, data can be exported into several ASCII formats.

Features:

Quick Communications

Standard icons have been used to simplify data logging functions. It automatically scans for a logger and readily displays data in an easy-to-read format. The commands are simple and intuitive.

Enhanced Zooming

Zooming is done by simple clicks of a button.

Improved Graphing Control

The software incorporates basic "plug and play" features and advanced graphing features of high-end data logging software.

Battery Life Indicator

This feature estimates when battery requires replacement.

Exporting Capabilities

Readily exports data into common spreadsheet formats.

Cable Specifications

PC Connector: Female DB-9 pin connector.

Logger Connector Use replaceable 3 wire male to male stereo cable

Cable Length: 1.2 meters (4 feet).

Figure 9:
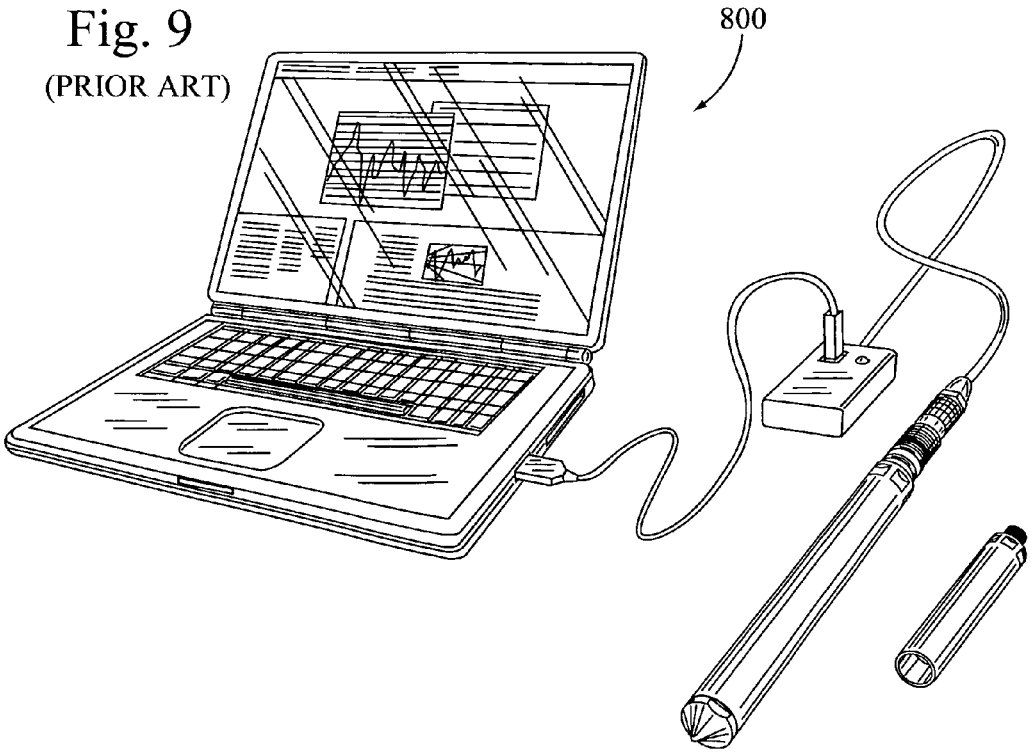
Fig. 9 (PRIOR ART)
FIG. 9 (prior art) is a perspective view of a computer connected to a multi-purpose data logger.
Figure 10:
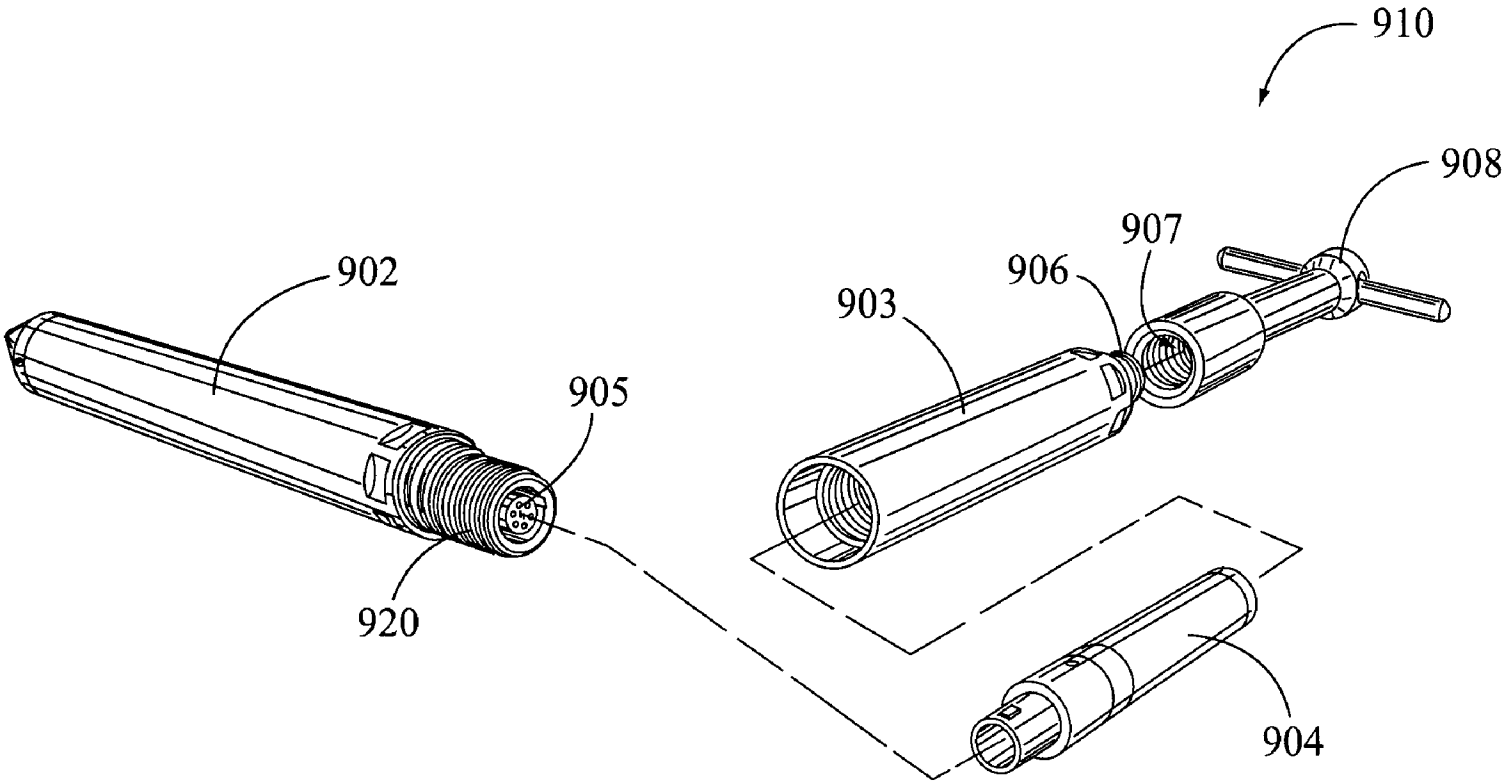
FIG. 10 is an exploded view of a data logger retraction tool.

In FIGS. 9, 10, prior art data logger/sensor 902 is used. Cal-Scan Services Ltd. developed the BADGER™ (1.25") and the MOLE™ (¾") to provide an alternative to the high power tools on the market today. With these temperature loggers, longer tests can be run without having to stack batteries to get the test in. Their tools will fill the memory with any sample rate on a single lithium "AA" battery. The savings in battery costs alone can make these tools a viable alternative to other tools on the market today. Thus, Cal-Scan Services Ltd. has been able to maintain high quality data and fast pressure/temperature response with one battery. Low power was not their only goal in building a memory recorder. They also made an attempt to build a user friendly, durable and dependable downhole tool. They use one software package and one interface box to program and download all of their tools. All housings are made of 718 INCONEL™ or equivalent material. The temperature loggers may come in a variety of pressure ranges from 750 psi to 15000 psi. They can also carry a fast response temperature tool in both 1.25" and ¾". The sample rate can be set as low as 1 sample per second. With 348000 sample, the tool can run for 4 days on a 1 second rate. The memory can be doubled to 696000 samples. Even with the memory doubled, the recorder can still fill the memory with any sample rate on a single "AA" battery.

A battery powered data retriever is hooked via adapter/cable 900, 901 to data logger/sensor 902. In operation downhole, battery 904 plugs into port 905 and then lid 903 is screwed over threads 920 to protect assembly 902, 904. In order to use assembly 902, 903 in a plunger, the present invention includes removal tool 910. Tool 910 has a female, threaded working end 90 to screw onto threaded nipple 906. Handle 908 allows the operator to engage/disengage assembly 902, 903 for use in various plungers disclosed herein.

Figure 1:
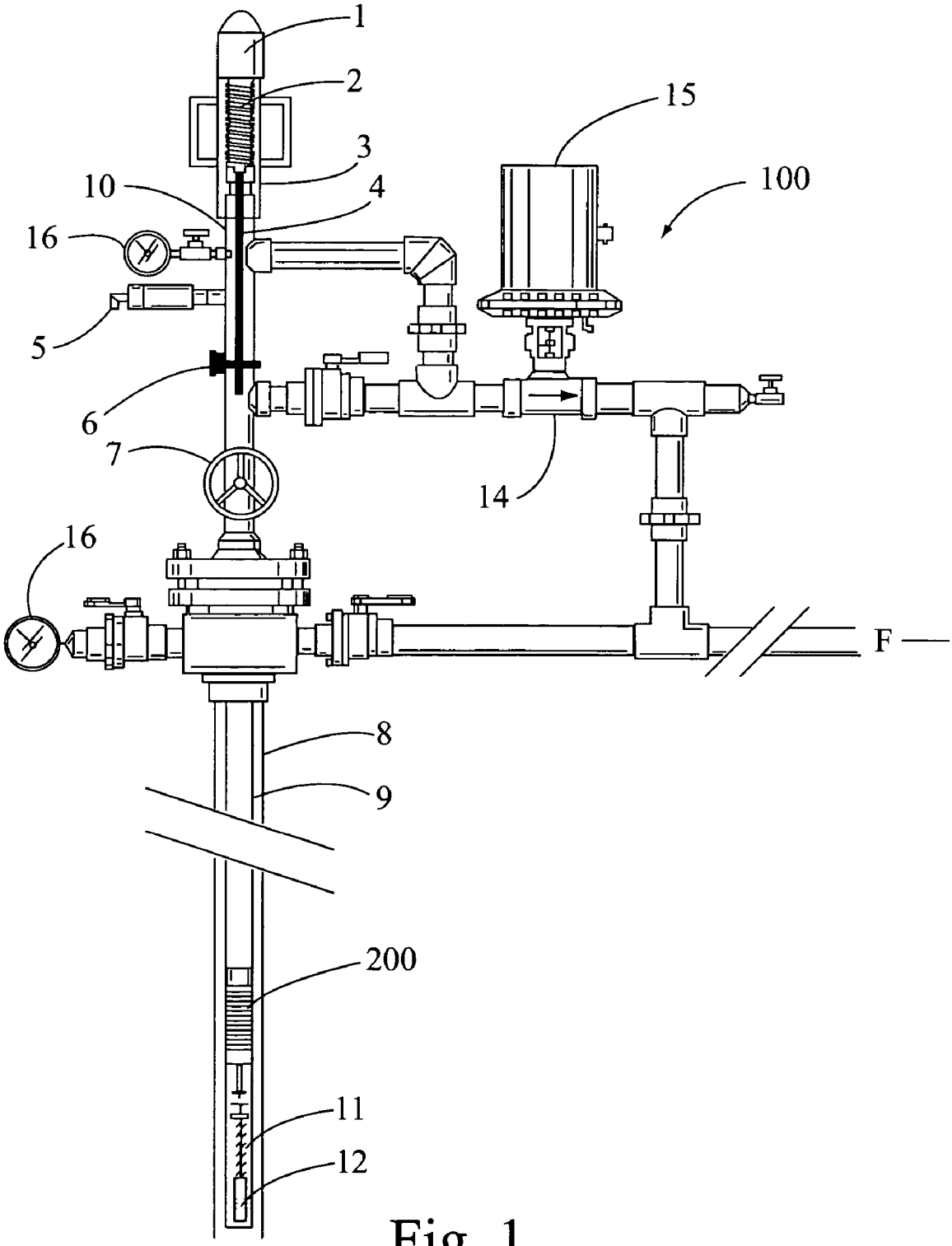
Fig. 1 (PRIOR ART)
FIG. 1 (prior art) is a schematic drawing of a typical plunger lift well.
Figure 2:
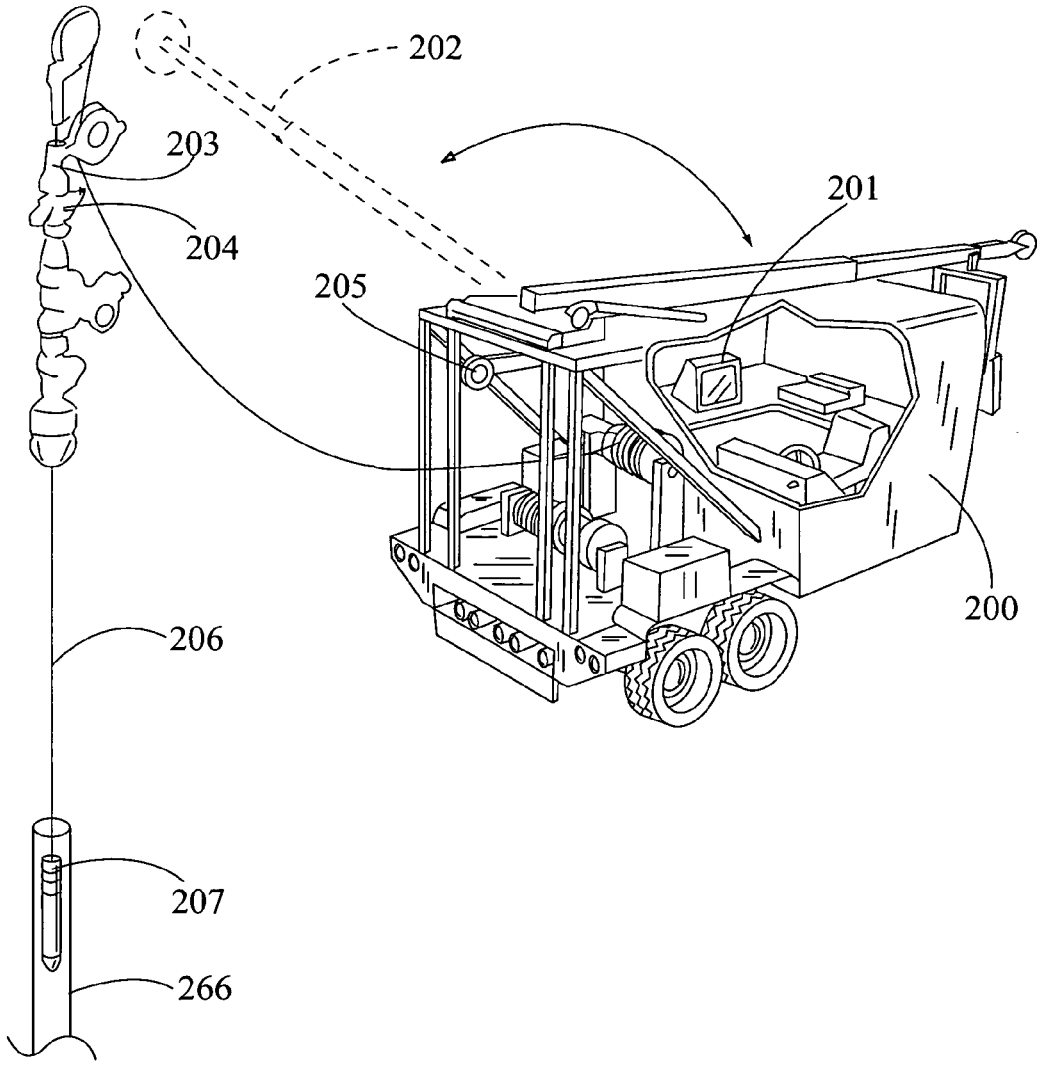
Fig. 2 (PRIOR ART)
FIG. 2 (prior art) is a perspective view of a special truck and conventional data logger vessel.
Figures 11, 11A:
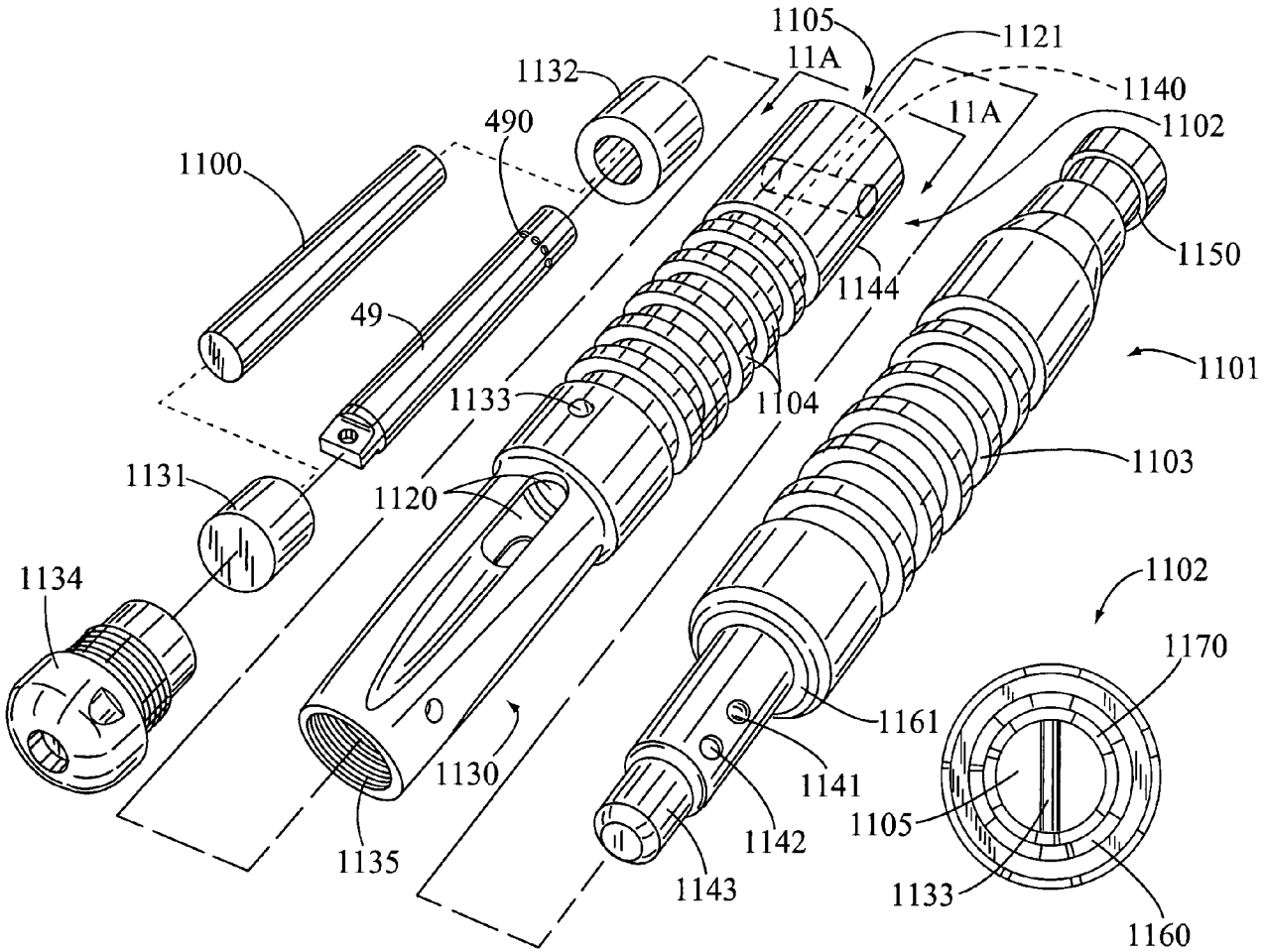
FIG. 11 is an exploded view of a data logger plunger and a retriever plunger.
FIG. 11A is a top plan view taken along line 11A-11A of FIG. 11.

Referring next to FIGS. 11, 11A cargo bay plunger 1102 consists of a standard ribbed body 1104 and flow through channel 1105. Oil/gas flows into inlets 1120 and out outlet 1121. Cargo bay 1130 consists of hollow housing 1105 connected to body 1102. Any payload can fit into hollow housing 1131 including data logger 49 or a metal sample (called a coupon) 1100. Coupons are used to study the corrosive effects of the downhole fluids. Shock absorbing mounting plugs 1131, 1132 can be made of a rubber such as VITON™. Plug 1132 is dead ended against crossbar 1133. A threaded bottom cover 1134 screws into female threads 1135, thereby compressing plugs 1131,1132 and securing payload (49 or 1100 etc.). Sample holes 490 line up with inlets 1120. Cargo bay plunger 1102 is ideally suited to be dropped downhole, to be left downhole for prolonged data sampling Cargo bay plunger 1102, with retriever plunger 1101, can be used as a regular production plunger as shown in FIG. 1. One way plunger 1102 can be "fished" from downhole is via retriever plunger 1101. The bottom end 1143 of plunger 1101 falls into outlet 1121 of plunger 1102 in a retrieve operation. Locking groove 1140 in neck 1144 of plunger 1102 receives locking ball 1141 of plunger 1101. On a sudden stop ball 1141 rolls from its travel position shown to a locking position at 1142. By turning assembly 1101, 1102 upside down, retriever plunger 1101 can be separated from plunger 1102. Ball 1141 rolls to the position shown. Standard outside diameter fish neck 1150 could be used to bring joined assembly 1101, 1102 to the surface. Normally it would flow up. Beveled port 1160 receives forward surface 1161. Inside wall 1170 forms the conduit for flow through channel 1105.

Figure 12:
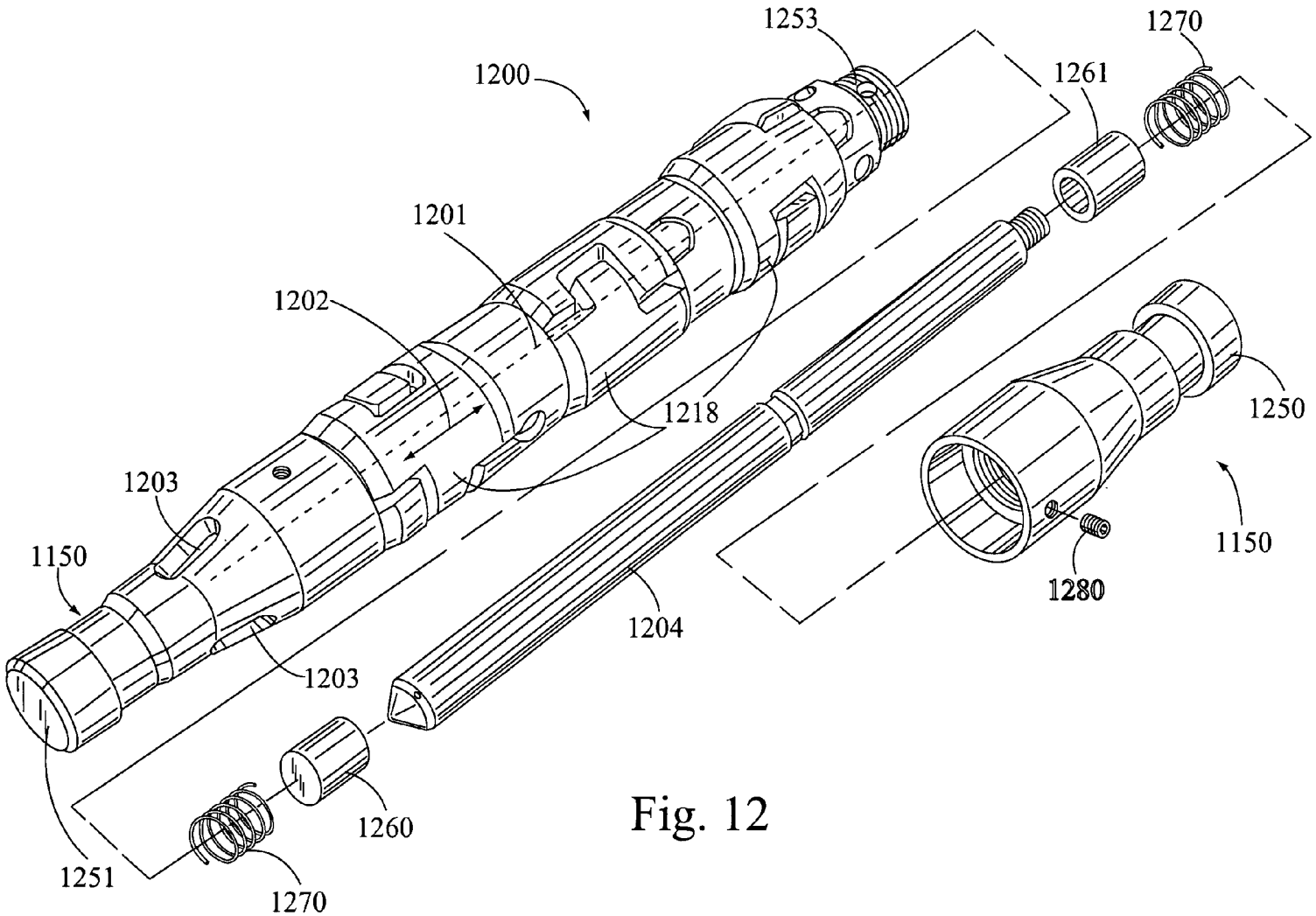
FIG. 12 is an exploded view of a pad plunger with a cargo bay and a cargo module, also called a payload.
Figure 13:
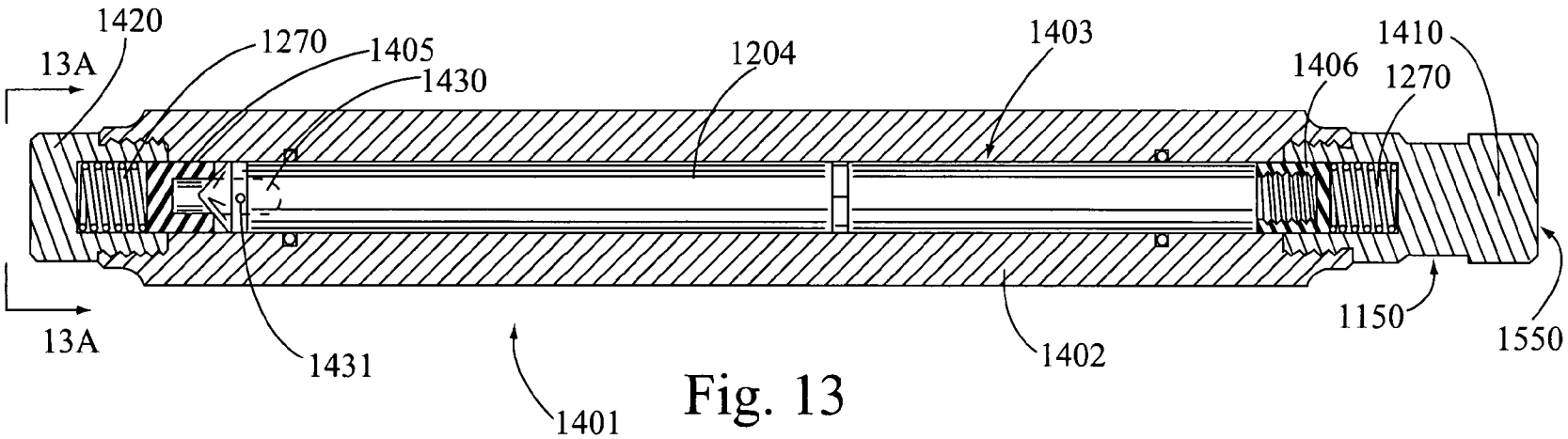
FIG. 13 is a longitudinal sectional view of a fast dropping, cargo bay plunger, suited to couple to a retriever plunger shown in FIG. 14.
Figure 13A:
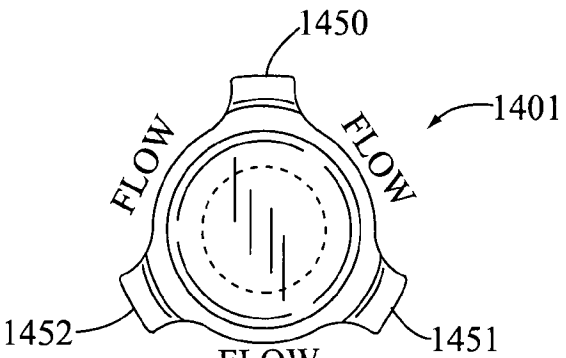
FIG. 13A is a top plan view of the FIG. 13 plunger.
Figures 14, 14A:
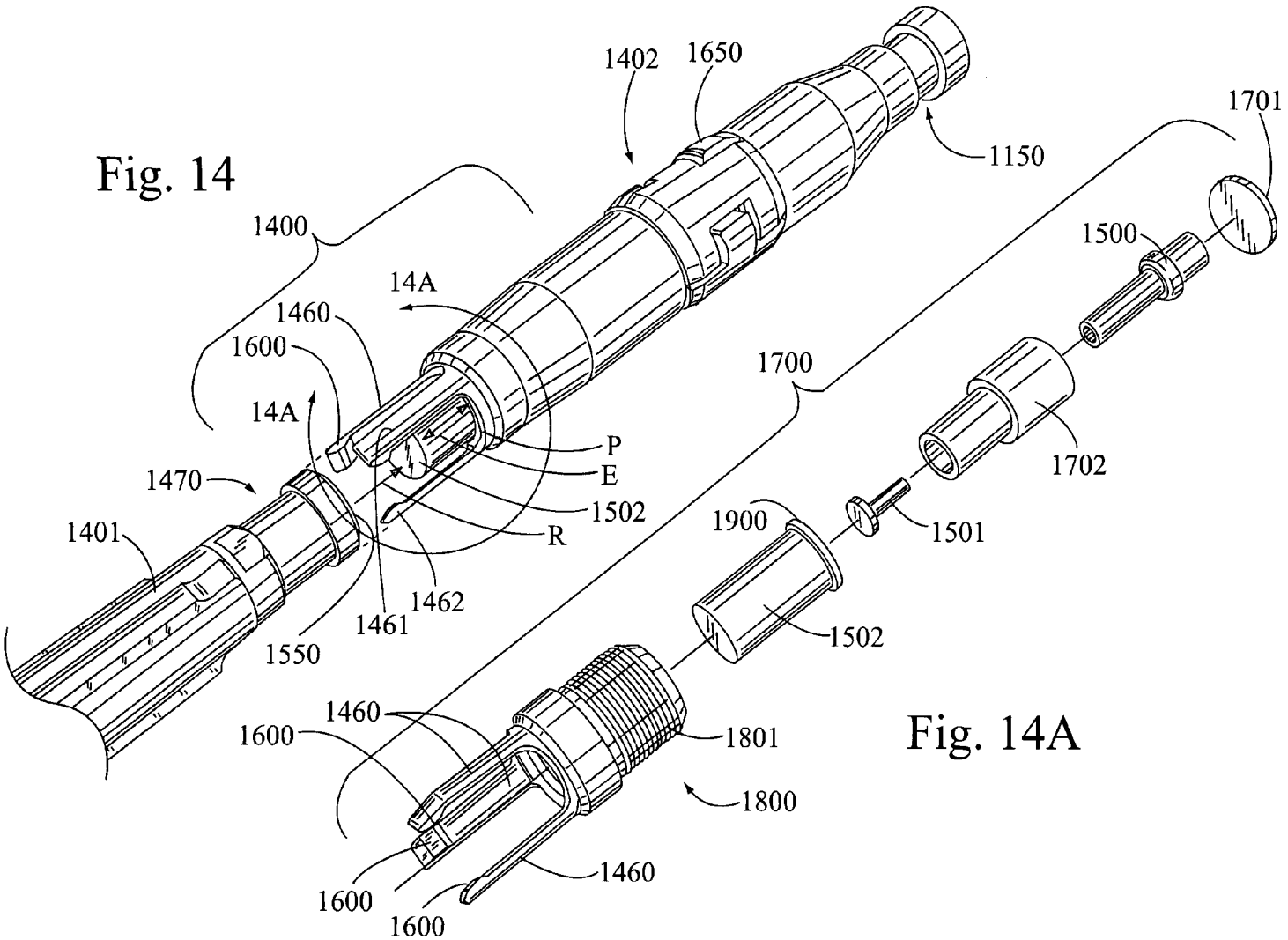
FIG. 14 is a top perspective view of the FIG. 13 plunger with its release plunger.
FIG. 14A is an exploded view of the thermal actuated disengagement assembly of the FIG. 14 apparatus.
Figure 15:
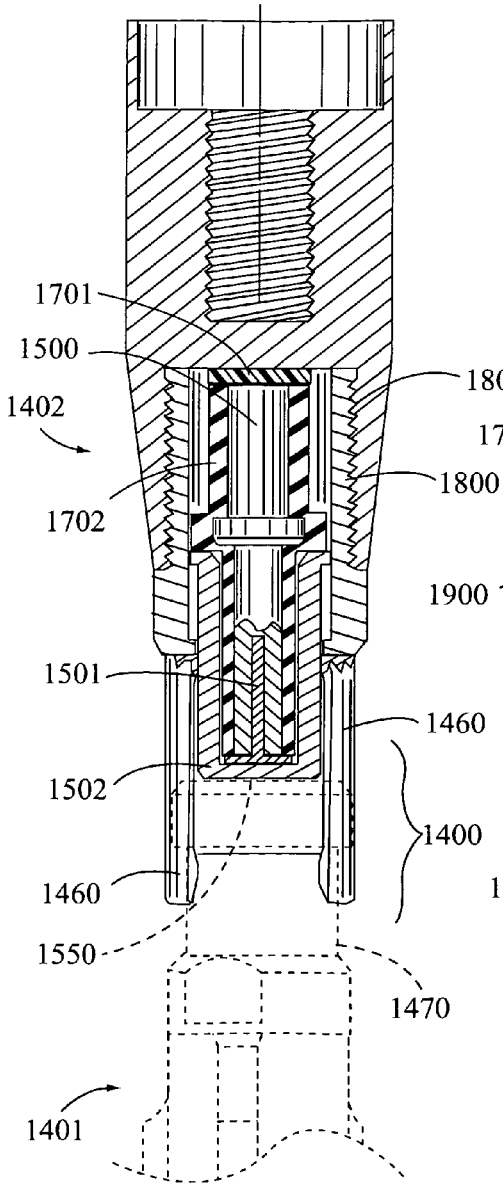
FIG. 15 is a longitudinal sectional view of the FIG. 14A disengagement assembly in the passive position.
Figure 15A:
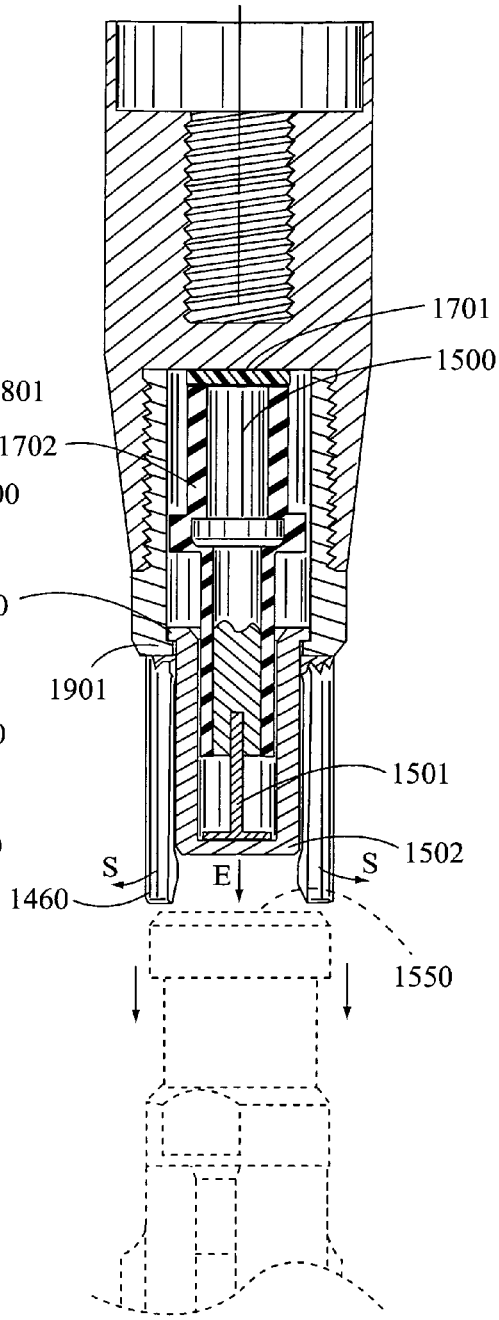
FIG. 15A is the same view as FIG. 15 with the disengagement piston extended.

Referring next to FIG. 12 the pad plunger 1200 has been drilled out (or cast) to provide cargo bay 1202 along its longitudinal axis 1201. Standard pads 1218 form the body of plunger 1200. No fluids flow through plunger 1200. Sensor sampling holes 1203 allow downhole fluids to reach payload 1204. Payload 1204 shown is FIG. 10 assembly 902, 903. Standard fish neck end 1150 exists at the bottom end 1251 and the top end 1250. Top end 1250 screws onto threaded top 1253 of plunger 1200, thereby compressing plugs 1260, 1261 against payload 1204 via springs 1270. Locking bolt 1280 prevents top end 1250 from unscrewing. Plunger 1200 is bidirectional. Payload 1204 could be anything from a coupon, liquid sampler (see FIG. 16 used without item 49), a data logger, etc. Plunger 1200 can be a reciprocating production plunger as shown in FIG. 1. Alternatively, any of the cargo bay plungers disclosed herein can be set at the bottom of a well to be retrieved at a later time.

Referring next to FIGS. 11, 11A, 13, 13A, 14, 14A, 15, 15A coupled plunger assembly 1400 consists of a fast falling cargo bay plunger that has large flow through channels to stay downhole with well flowing 1401 and retriever plunger 1402. Fast falling plunger 1401 has solid body 1402 with cylindrical cargo bay 1403 located along its central axis. Payload 1204 is shown mounted in cargo bay 1403. Plugs 1405, 1406 protect payload 1204 and along with springs 1270 provide a shock absorbing mounting system. Top and bottom members 1410, 1420 compress springs 1270. Collection slots 1430 allow fluid into sampler holes 1431 of payload 1204.

Plunger 1401 is an outside diameter flow design, wherein rails 1451, 1452, 1453 guide the plunger downhole, while fluids pass in channels labeled FLOW. High speeds of 3000 feet per minute could be achieved if plunger 1401 were allowed to free fall. Plunger 1401 is suited to remain downhole for a prolonged period with the well flowing before retrieval.

In order to drop plunger 1401 downhole, retriever plunger (also called a carrier plunger) 1402 is coupled to it via spring arms 1460, 1461, 1462 which clasp fish neck 1470 via ramps 1600. Coupled assembly 1400 falls at a normal speed downhole. At the bottom of the well heat acts upon thermal actuator 1500, thereby extending piston 1501. Piston 1501 pushes disengagement plug 1502 against top surface 1550 of top 1410. Arrow release R shows plug 1502 having pushed retriever plunger 1402 away from plunger 1401. Plug 1502 moves in directions passive P and extended E. Retriever plunger 1402 can be returned to the surface by the flow of the well leaving cargo bay plunger 1401 on the bottom of the well for long term testing.

Body 1650 of retriever plunger 1402 could be a pad type or any chosen design. Disengagement assembly 1700 consists of rubber mounting plug 1701, thermal actuator 1500 (with piston 1501) housed in an insulator jacket (rubber) 1702, wherein piston 1501 pushes disengagement plug 1502 to extended position E. Spring arm assembly 1800 screws into body 1650 of plunger 1402 via threaded male end 1801. Plug rim 1900 hits ledge 1901 in position E thus providing a stop for plug 1502. Arrows spring S show how spring arms 1460 move to release fish neck 1470. Spring arms 1460 have memory to return to the passive position shown in FIG. 15.

Figure 16:
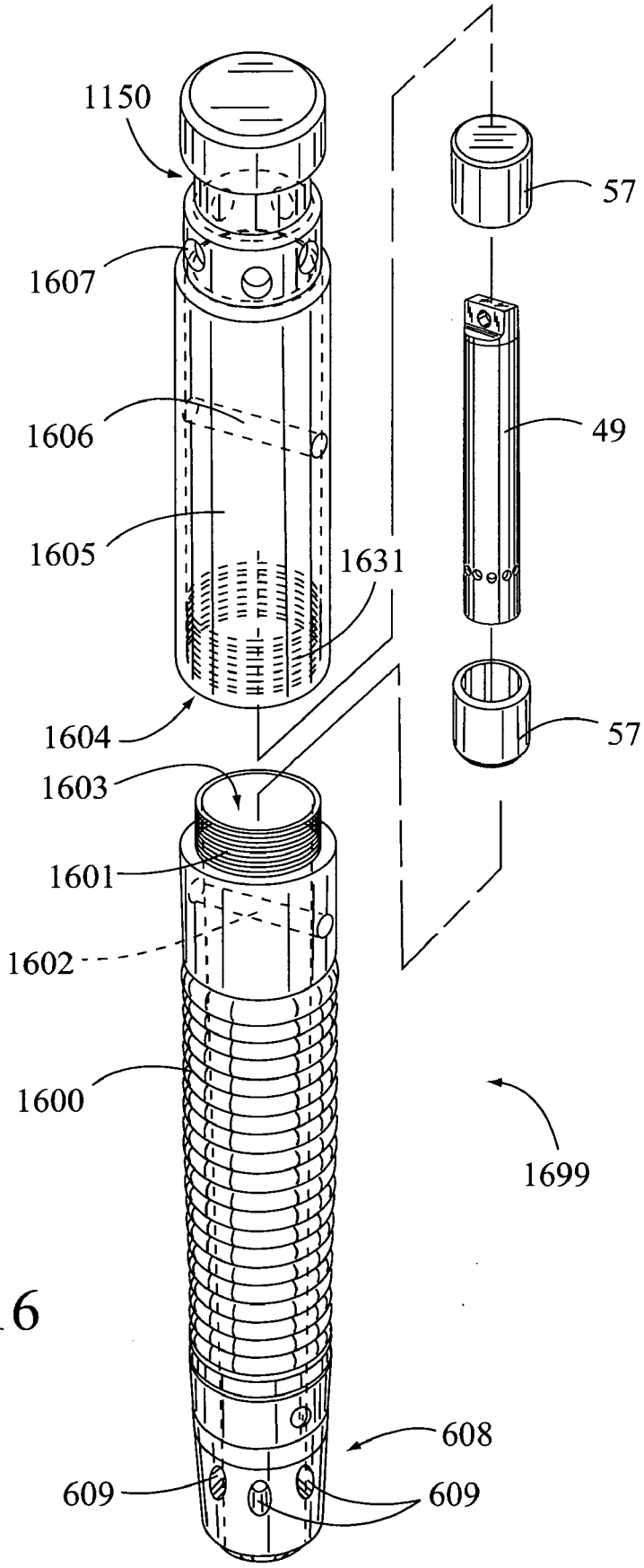
FIG. 16 is an exploded view of a canister type plunger with a fluid flow through the plunger and the canister.

Referring next to FIG. 16 flow through plunger 1699 has body 1600 with an external geometry. As in all the plungers disclosed herein, the term external geometry includes smooth or rails or any surface chosen to travel inside a tube. Fluid inlet ports 609 allow downhole fluids and gas to flow out outlet 1603 and into inlet 1604 of removable canister 1605. Threaded male connector 1601 allows threaded female end 1631 of the canister to be threaded onto it. Pins 1602, 1606 compress stops 57 to firmly mount data logger 49 therebetween. The outside diameter of the data logger (or any environmental sampling container) is chosen smaller than the inside diameter of canister 1605, thereby allowing a fluid flow from inlet 1604, through canister 1605, past data logger 49, and out outlet ports 1607.

Although the present invention has been described with reference to disclosed embodiments, numerous modifications and variations can be made and still the result will come within the scope of the invention. No limitation with respect to the specific embodiments disclosed herein is intended or should be inferred. Each apparatus embodiment described herein has numerous equivalents.

I claim:

1. A method of retrieving data from a well environment, said method comprising the steps of:

providing an external flow plunger having a cargo mounted therein, said cargo capable of logging one or more data from said well environment;

coupling a carrier plunger to the external flow plunger;

dropping the tandem external flow and carrier plungers in a well tube;

uncoupling the carrier plunger from the external flow plunger whereby the external flow plunger can remain in the well tube to log one or more data;

retrieving said carrier plunger from the well tube;

coupling a retriever plunger to the external flow plunger whereby the tandem external flow and retriever plungers can be retrieved; and retrieving one or more data logged by the cargo.

2. The method of claim 1, wherein the step of uncoupling further comprises using downhole heat to thermally actuate an extendable piston to push the external flow plunger from the carrier plunger.

3. The method of claim 1, wherein a logging of one or more data can occur at a well surface.

4. A plunger comprising:

a mandrel having a upper member and a lower member, each of said members being hollow in a portion thereof;

said upper member and said lower member being removably coupled to one another, said hollow portions of each member together forming a centrally interposed cavity during a coupling of said members;

a cargo housed in said cavity between a pair of stops; and said mandrel having sampler holes to enable a downhole gas flowing past an external surface of said mandrel to communicate with said cargo to characterize a downhole environment.

5. The plunger of claim 4, wherein the cargo further comprises a data logger.

6. The plunger of claim 5, wherein the data logger further comprises a battery, a sensor, and a data storage module.

7. The plunger of claim 4 further comprising a shock absorber adjacent an opposing end of the cargo and each of said pair of stops.

8. The plunger of claim 4, wherein said mandrel further comprises a nonreciprocating longitudinal guide rail extending along a majority of its length to cause a bypass fluid flow path therebetween and to enable the plunger to stay downhole until its retrieval by a retriever plunger.

9. The plunger of claim 4, wherein the cargo further comprises a microprocessor.

10. The plunger of claim 4, wherein the cargo further comprises a corrosion coupon.

11. The plunger of claim 4 further comprising a coupling mechanism for coupling to a carrier, said carrier operating to deliver the plunger downhole and/or to retrieve the plunger from downhole.

12. The plunger of claim 4, wherein said upper member and/or said lower member can further comprise one or more members.

13. A method of ascertaining a downhole environment, said method comprising the steps of:

providing a plunger having a upper member and a lower member, each of said members being hollow in a portion thereof; said upper member and said lower member being removably coupled to one another, said hollow portions of each member together forming a centrally disposed enclosure during a coupling of said members;

allowing a cargo housed in said enclosure between a pair of stops to communicate with a downhole gas flowing past an external surface of said plunger by means of a sampler hole;

allowing the cargo to log one or more data from a downhole environment; and retrieving the one or more data to ascertain the downhole environment.

14. A coupled set of plungers suited to travel downhole in a tube, said apparatus comprising:

a data retrieving plunger housing a cargo in an internal bay, the cargo positioned between a pair of protective stops, the data retrieving plunger having a threaded removable end to allow access to the internal bay, the removable end further comprising a fish neck mechanism;

a delivery plunger having a bottom end assembly to engage the fish neck of the data retrieving plunger and to carry the data retrieving plunger downhole;

the bottom end assembly further comprising a thermal actuator sealed in a rigid housing, said actuator expandable with an increase in downhole temperature to move an extendable piston to a position whereby the data retrieving plunger is pushed from said bottom end assembly, whereby the data retrieving plunger is released from the carrier plunger and left downhole for a testing period; and wherein fluid flowing past the data retrieving plunger communicates with a sensing component of the cargo.

15. The apparatus of claim 14, wherein said cargo further comprises a data logger.

16. The plunger of claim 15, wherein one or more data logged by said data logger can be used for well optimization and/or well control.

17. The apparatus of claim 14, wherein said bottom end assembly further comprises at least two spring arms to engage said fish neck.

* * * * *